United States Patent [19]

Finnemore et al.

[11] 4,206,803

[45] Jun. 10, 1980

[54] ROTOR TURNDOWN SENSOR AND CONTROL

[75] Inventors: Harlan E. Finnemore, Wellsville; Roderick J. Baker, Belmont, both of N.Y.

[73] Assignee: The Air Preheater Company, Inc., Wellsville, N.Y.

[21] Appl. No.: 973,217

[22] Filed: Dec. 26, 1978

[51] Int. Cl.[2] ..... F28D 19/00

[52] U.S. Cl. ..... 165/9

[58] Field of Search ..... 165/9

[56] References Cited

U.S. PATENT DOCUMENTS

| | | | |
|---|---|---|---|
| 3,404,727 | 10/1968 | Mock | 165/9 |
| 4,124,063 | 11/1978 | Stockman | 165/9 |

*Primary Examiner*—Albert W. Davis

*Attorney, Agent, or Firm*—Wayne H. Lang

[57] ABSTRACT

Rotary regenerative heat exchange apparatus in which a rotor of heat absorbent material is alternately exposed to a heating fluid and to a fluid to be heated. The rotor is surrounded by a housing having a sector plate at opposite ends thereof adapted to separate the heating fluid from the fluid to be heated. The apparatus is provided with control means that intermittently drives a sector plate into a sealing relationship with the adjacent edge of the rotor after which a predetermined reference point on the rotor activates a sensor to move the sector plate away from the rotor to permit freedom of movement therebetween.

6 Claims, 6 Drawing Figures

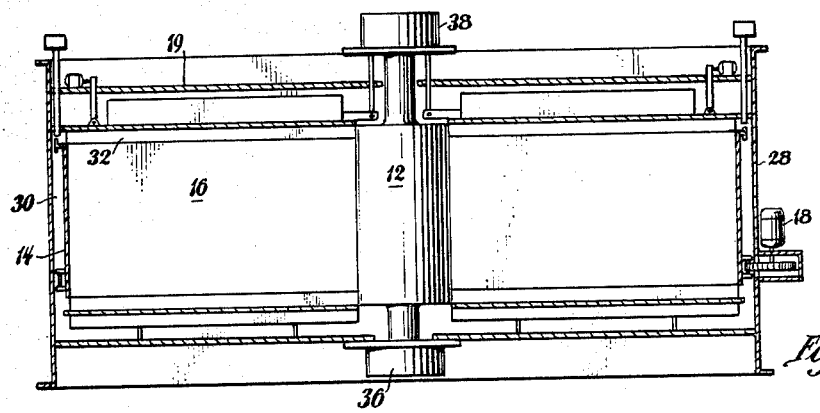
Fig. 1
Fig. 5
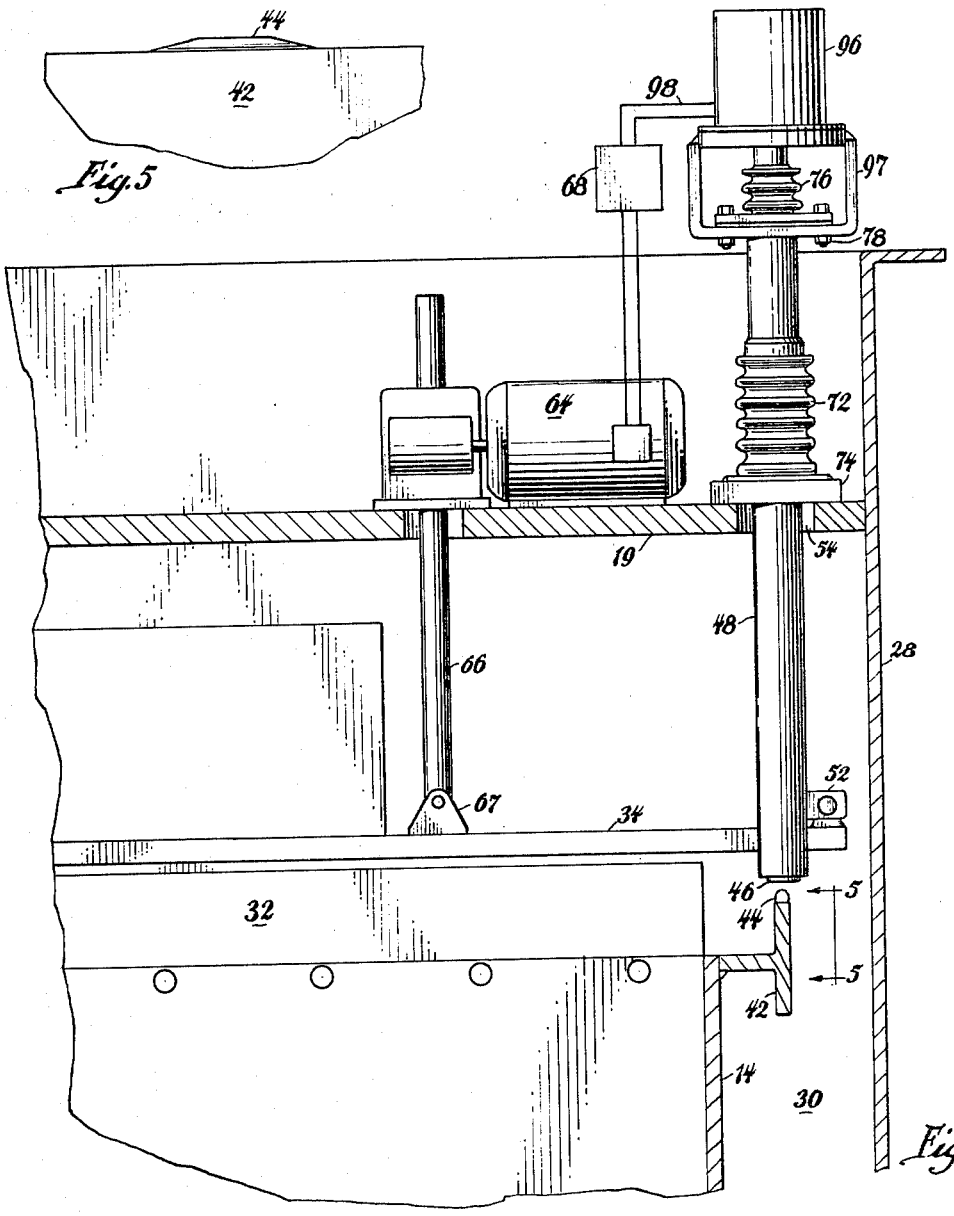
Fig. 2

ROTOR TURNDOWN SENSOR AND CONTROL

BACKGROUND OF THE INVENTION

The present invention is directed to rotary regenerative heat exchange apparatus that comprises a cylindrical mass of heat exchange material carried by a rotor around a central rotor post. The rotor is rotated about its axis slowly to alternately subject opposite sides of the rotor to streams of a heating fluid and a fluid to be heated.

When opposite sides of the rotor are subjected to extremes of temperature, the rotor is subjected to differential expansion that causes the rotor to deform and thereby alter the sealing relationship being maintained between the rotor and surrounding housing structure.

Since hot gases are usually ducted to the rotor from above and cool gases from below, the top of the rotor expands more than does the bottom of the rotor to assume the shape of a shallow inverted bowl conveniently called rotor "turndown".

Rotor turndown produces an excessive amount of leakage at the upper or hot end of the rotor. Consequently, various arrangements have been developed to provide sealing arrangements that permit rotor turndown while they provide a satisfactory deterrent to the leakage of the several fluids. The art is replete with examples of apparatus developed to contain fluids in heat exchangers subject to thermal deformation. U.S. Pat. Nos. 3,246,687 and 3,786,868 suggest moving a sector plate in accordance with rotor turndown, while U.S. Pat. Nos. 3,088,518 and 3,095,036 suggest moving a sealing means to fill an opening provided by the rotor turndown.

Thus it is common to provide variable sealing arrangements at the ends of the rotor to preclude the cross-flow of fluids being directed therethrough. A new approach to the sealing problem is advanced by U.S. Pat. No. 4,124,063 in which a sector plate at the end of the rotor is deformed into a curvilinear shape to correspond to rotor turndown on the adjacent face of the rotor.

SUMMARY OF THE INVENTION

This invention accordingly provides apparatus for sensing rotor turndown and then controlling the bending of an adjacent sector plate. More particularly, this invention provides an arrangement for sensing the rotor turndown and then transforming a signal that results therefrom to a force that similarly deforms an adjacent sector plate to minimize fluid leakage therebetween.

BRIEF DESCRIPTION OF THE DRAWING

Other objectives and arrangements for achieving these objectives will become more apparent from the specification and the accompanying drawing in which:

FIG. 1 is a side elevation of rotary regenerative heat exchange apparatus involving the present invention, FIG. 2 is an enlarged detail drawing showing the features of the invention, FIG. 5 is an enlarged detail showing a bump on a T-bar.

DESCRIPTION OF THE PREFERRED EMBODIMENT

Figure 3:
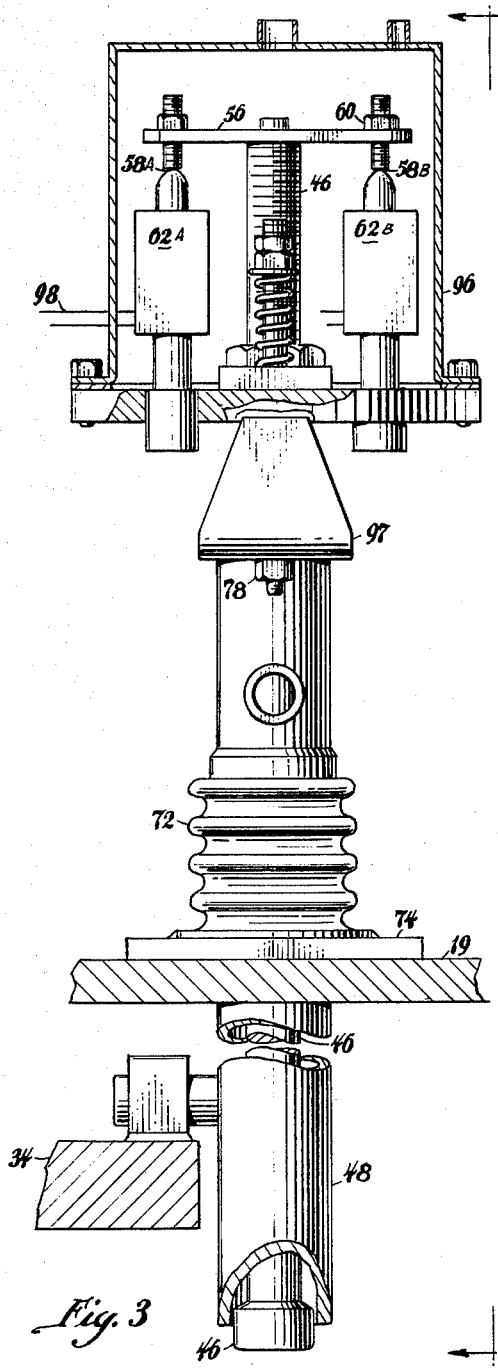
FIG. 3 is an enlarged side view of the particular sensing and control means.
Figure 4:
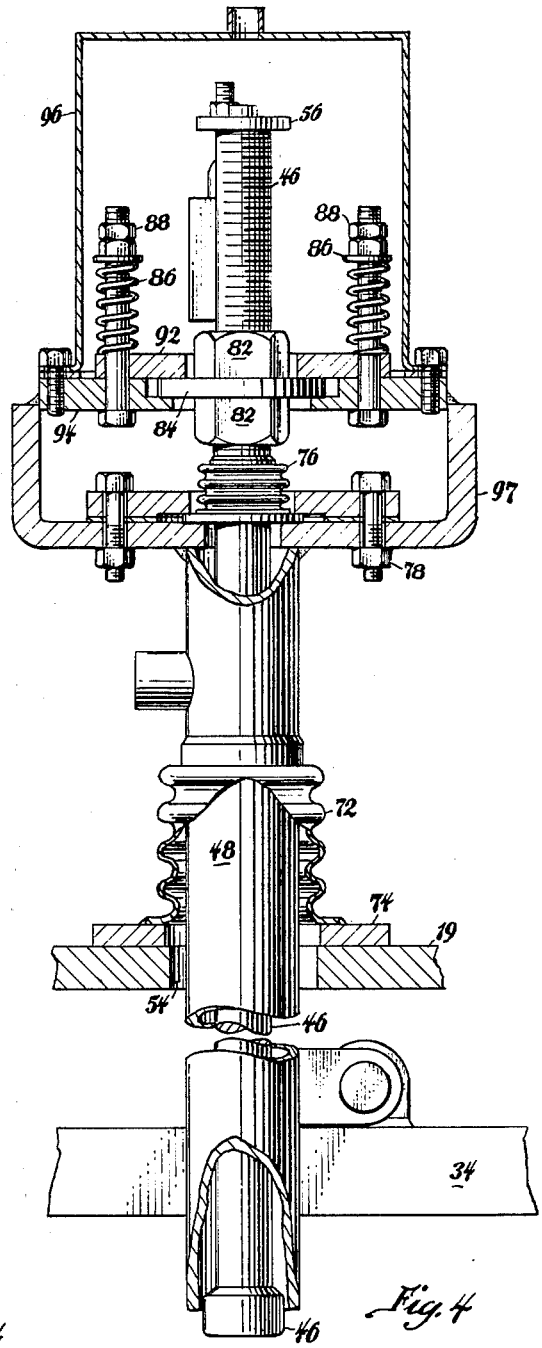
FIG. 4 is an enlarged side view, partially broken away, showing the device as seen from line 4—4 of FIG. 3.

The heat exchanger includes a vertical rotor post 12 and a concentric rotor shell 14 having a space therebetween filled with a mass of permeable heat absorbent element 16 that is carried by a rotor and rotated slowly about its axis by a motor and drive means 18 so that it may absorb heat from a heating fluid and then transfer the heat to a fluid to be heated that are being directed through their respective passageways.

Hot gas or other heating fluid enters the heat exchanger through an inlet duct 20 and then is discharged through an outlet duct 22 after traversing the heat absorbent element 16 that is positioned therebetween. Cool air or other fluid to be heated enters the heat exchanger through an inlet duct 24 and is discharged through an outlet duct 26 after flowing over the heated element 16. After passing over the hot element, the cool air absorbs heat therefrom and is accordingly directed to its place of use.

A cylindrical housing 28 encloses the rotor to provide an annular space 30 therebetween, while apertured end plates 19 are positioned at opposite ends of the rotor housing to direct gas and air therethrough. Sector plates 34 are positioned intermediate opposite ends of the rotor and the end plates to maintain the several fluids in their respective passageways, while radial sealing means 32 are customarily affixed to the end edges of the rotor and adapted to rub against the face of the adjacent sector plate so as to preclude the leakage of fluid therebetween.

In most heat exchanger installations, hot gas enters from the top, transferring its heat to the heat absorbent material of the rotor before it is discharged through outlet duct 22 as a cooled gas. Conversely, cool air enters the bottom inlet 23 and is exhausted through outlet 25 after having been in contact with the relatively hot rotor. Inasmuch as the inlet for the hot gas and the outlet for the hot air customarily lie at the top of the heat exchanger, the top is called the "hot end" while that lying adjacent the cold air inlet is called the "cold end" of the rotor.

Figure 6:
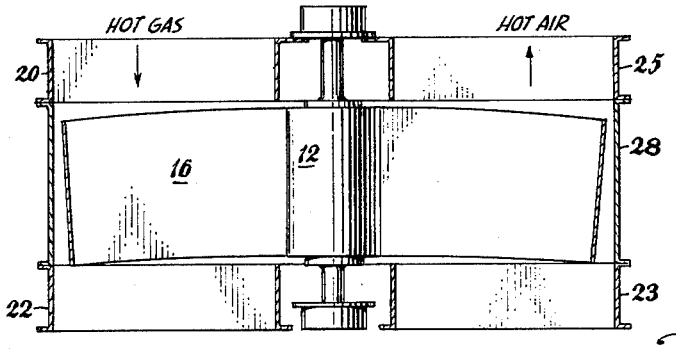
FIG. 6 is a diagrammatic representation of a rotary regenerative heat exchanger having rotor turndown.

The upper end of the rotor is therefore subject to maximum thermal expansion, while the lower or cold end is subject to a lesser amount in accordance with the diagrammatic illustration of FIG. 6. The result of this thermal deformation of the rotor is to increase the clearance space between the top of the rotor and surrounding housing structure so as to substantially increase fluid leakage therebetween and lower the effectiveness of the heat exchanger.

A fixed support bearing 36 at the bottom of the rotor supports the central rotor 12 for rotation about its axis, while the upper end of the rotor supports a radial guide bearing 38 that also supports the inboard end of each sector plate in accordance with the axial expansion and contraction of the rotor post.

In accordance with U.S. Pat. No. 4,124,063 an arrangement is provided for arcuately deforming the sector plate until it corresponds to the profile of the rotor similar to the rotor turndown to thus permit a minimum of fluid leakage between the rotor and the surrounding rotor housing. The present invention provides a particular sensing means and actuator that performs this operation.

An annular T-bar 42 is attached to an end edge of the rotor 14. The T-bar includes a hardened bump 44 which becomes the contact point for the rotor when it is rotated about its axis. A tube 48 carrying a sensor rod 46 has a hardened end that is adapted to interfere with the bump 44 on T-bar 42 when the rotor is rotated about its axis.

The tube 48 that surrounds the sensor rod 46 is pivotally attached at 52 to the sector plate, while it freely traverses an opening 54 in spaced end plate 19 whereby it may be moved relative thereto. Thus the sensor rod 46 is essentially independent from the surrounding tube 48.

The upper end of the sensor rod has secured thereto a cross member or yoke 56 carrying breaker points 58A and 58B at opposite ends thereof. The contact points are screw mounted so they may be adjusted vertically by turning, and they may be locked in any position by tightening nuts 60 so as to provide a predetermined relationship with adjacent switches 62A and 62B.

The points 58A and 58B are adjusted to break contact from the switches 62A and 62B in response to a predetermined amount of vertical movement of rod 46. One switch is designated as the primary switch while the other is a secondary or "standby" switch. The switches activate a motor and gearing arrangement 64 that reversely drives actuating rod 66. The actuating rod 66 is connected to a pivot 67 whereby the sector plate 34 may selectively be moved up or down in accordance with its actuation. A conventional timer 68 controls movement of the motor 64 in accordance with a predetermined sequence of operation, although the sequence of operation may be modified by a signal from switch 62 that results from axial movement of rod 46.

For example, once each hour (or other period) the control means 68 may be set to operate the motor 64 to drive the actuating rod 66 down until contact is made between the rod 46 and the bump 44 on T-bar 42. Upon contact, the control rod 46 will move point 58A away from switch 62A signalling the sector plate drive motor 64 to reversely actuate the sector plate a short distance away from the radial seals to provide freedom of movement therebetween. The optimum reverse movement of the sector plate is usually limited to from ⅛" to ¼".

In normal operation the timer 68 is programmed to actuate motor 64 whereby it drives rod 66 downward after each hour or other predetermined period of time. When the sector plate is moved down it carries with it the sensor rod 46 so that it eventually comes in contact with bump 44 on T-bar 42. Further downward movement of the sector plate axially moves rod 46 and yoke upward to relieve the contact point 58A from switch 62A. This signals the motor to reverse and retract the sector plate⅛" (or other predetermined distance).

The timer 68 is set to repeat this procedure each hour. Therefore, as turndown increases, reverses or stabilizes, the sector plate is periodically deformed to assume a configuration similar to that at the end of the rotor.

If rotor turndown should decrease, the bump 44 on T-bar 42 will contact sensor rod 46 moving yoke 56 and contact point 58A upward and away from switch 62A. The motor 64 will consequently be reversely actuated and the actuating rod 66 will retract the sector plate 34 about ¼" (or other programmed amount) from adjacent radial seals 32.

Flexible sealing means are provided around tube 48 to preclude fluid leakage through the annular space 54. Accordingly a flexible bellows 72 surrounds tube 48 and has one end secured thereto while the opposite end is secured to the end plate 19 at 74. Similarly, flexible sealing bellows 76 precludes fluid flow between the sensor rod 46 and the tube 48. The bellows 76 has one end thereof attached to the rod 46 while the other end thereof is secured to concentric tube 48. The bellows 76 is removably secured to tube 48 by clamping means 78 whereby removal of the clamping means will permit separation of the sensor rod 46 from the surrounding tube 48.

The upper end of sensor rod 46 is threaded to permit spaced nuts 82 to hold therebetween an annular member 84 that provides a base that is biased down by compression spring 86 acting against follower 92. Thus compression springs 86 held between adjusting means 88 and follower 92 exert a downward force on the flange 84, forcing it to lie normally against its seat in member 94. When the flange 84 is seated, the points 58 are properly adjusted to be in contact with switch 62. Thus the slightest upward movement of sensor rod 46 will move the yoke 56 and contact points 58 up, opening the switch means 62.

The seat member 94 is supported by the same U-shaped bracket 96 to which the clamping means 78 for bellows 76 is attached.

A cup-shaped dust cover 96 is secured to the same seat member 94 to prevent excess dust from accumulating on the switches and spring biasing means. The dust cover is provided with a suitable aperture therein that permits the egress of conductors 98 that lead to the control means 68.

While only a single switch 62A has been described as being essential to the operation of the device, a second switch 62B is included as a back-up switch that will operate in the event of a failure of primary switch 62A.

What is claimed is:

1. Rotary regenerative heat exchange apparatus having a central rotor post, a rotor shell concentrically around said rotor post to provide an annular rotor therebetween, a mass of heat absorbent material carried by said rotor, a rotor housing having apertured end plates at opposite ends of the rotor adapted to direct a heating fluid and a fluid to be heated to and through the rotor, means for rotating the rotor about its axis to align the heat absorbent material of the rotor with the heating fluid and the fluid to be heated, a sector plate intermediate an end of the rotor and an end plate adapted to separate the heating fluid from the fluid to be heated, means supporting the inboard end of the sector plate, an axial projection carried by the end edge of the rotor, an actuating means connected to the outboard end of the sector plate to drive it axially toward said projection, means for motivating the actuating means, a limit switch actuated by axial movement of said projection, and an axially disposed sensor rod intermediate the projection and the limit switch adapted to actuate the switch in response to axial movement of the projection.

2. Rotary regenerative heat exchange apparatus as defined in claim 1 including a breaker point carried by said sensor rod, and means adapted to bias the breaker point in contact with the limit switch.

3. Rotary regenerative heat exchange apparatus as defined in claim 2 including aligned openings in the sector plate and in the end plate for said sensor rod traversed by said sensor rod.

4. Rotary regenerative heat exchange apparatus as defined in claim 3 including an open ended tube surrounding the sensor rod, and sealing means intermediate the sensor rod and the surrounding tube to preclude the leakage of fluid therethrough.

5. Rotary regenerative heat exchange apparatus as defined in claim 4 including a bracket between the tube and the sector plate, and pivot means mounted on the sector plate adjacent said tube adapted to support the tube for pivotal movement about an axis normal to that of said rotor.

6. Rotary regenerative heat exchange apparatus as defined in claim 5 including spring means adapted to bias the limit switch into a closed position.

* * * * *